US007503296B2

(12) United States Patent
Rozario et al.

(10) Patent No.: US 7,503,296 B2
(45) Date of Patent: Mar. 17, 2009

(54) CYLINDER DEACTIVATION APPARATUS

(75) Inventors: Frederick J. Rozario, Fenton, MI (US); William C. Albertson, Clinton Township, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 305 days.

(21) Appl. No.: 11/402,540

(22) Filed: Apr. 12, 2006

(65) Prior Publication Data

US 2007/0240659 A1 Oct. 18, 2007

(51) Int. Cl.
*F01L 1/34* (2006.01)

(52) U.S. Cl. ..... 123/90.16; 123/90.12; 123/90.15; 123/90.17; 123/198 F; 123/90.52

(58) Field of Classification Search ..... 123/90.16, 123/198 F
See application file for complete search history.

(56) References Cited

U.S. PATENT DOCUMENTS 4,167,931 A * 9/1979 Iizuka ..... 123/198 F
6,557,518 B1 * 5/2003 Albertson et al. ..... 123/198 F
6,584,951 B1 7/2003 Patel et al. ..... 123/198 F
6,920,849 B2 * 7/2005 Haas et al. ..... 123/90.12
7,032,564 B1 * 4/2006 Kryglowski et al. ..... 123/198 F
7,040,265 B2 * 5/2006 Falkowski et al. ..... 123/90.16
7,082,918 B2 * 8/2006 Rozario et al. ..... 123/196 R
2005/0045142 A1 3/2005 Rozario et al.

* cited by examiner

*Primary Examiner*—Thomas E Denion
*Assistant Examiner*—Kyle M Riddle

(57) ABSTRACT

An internal combustion engine having a cylinder block defining a plurality of cylinders at least half of which are selectively deactivatable by a plurality of switching hydraulic lifters. A source of pressurized oil is provided. Additionally, at least one solenoid-actuated hydraulic control valve operates to selectively communicate pressurized oil from the source of pressurized oil to actuate the plurality of switching hydraulic lifters thereby deactivating the selectively deactivatable cylinders. The number of the solenoid-actuated hydraulic control valves is fewer than the number of selectively deactivatable cylinders.

19 Claims, 4 Drawing Sheets

CYLINDER DEACTIVATION APPARATUS

TECHNICAL FIELD

The present invention relates to a cylinder deactivation system for an internal combustion engine.

BACKGROUND OF THE INVENTION

Variable displacement internal combustion engines provide improved fuel economy and torque on demand by operating on the principle of cylinder deactivation. During operating conditions that require high output torque, every cylinder of a variable displacement internal combustion engine is supplied with fuel and air. Alternately, during operating conditions at low speed, low load, and/or other inefficient conditions for a fully displaced internal combustion engine, cylinders may be deactivated to improve the fuel economy of a vehicle equipped with the variable displacement internal combustion engine. For example, in the operation of a vehicle equipped with an eight cylinder variable displacement internal combustion engine, fuel economy will be improved if only four cylinders of the internal combustion engine are operated during relatively low torque operating conditions by reducing throttling losses. Throttling losses, also known as pumping losses, are the extra work that an internal combustion engine must perform to pump air from the relatively low pressure of an intake manifold, across intake and exhaust valves, and out to the atmosphere. The deactivated cylinders will disallow airflow across their respective intake and exhaust valves, thereby reducing pumping losses by forcing the internal combustion engine to operate at a higher intake manifold pressure. Since the deactivated cylinders do not allow air to flow, additional losses are avoided by operating the deactivated cylinders as "air springs" due to the compression and decompression of the air within each deactivated cylinder.

It is known in the art of engine cylinder deactivation to provide switchable hydraulic lash adjusters operable to either actuate the valves of a deactivatable cylinder or to maintain the valves in a closed position through lost motion features of the hydraulic lash adjusters. Similar mechanisms may be provided within a hydraulic valve lifter, which includes a hydraulic lash adjusting mechanism and so may be referred to broadly as a hydraulic lash adjuster.

Hydraulic lash adjusters are supplied with pressurized oil through a lash adjuster gallery or lifter oil passage to annular feed grooves, which provide oil pressure to take up the lash in the valve train between the valve tip and its associated rocker arm or other-actuator. Hydraulic lash adjusters and hydraulic valve lifters that are configured to effect cylinder deactivation typically have an additional port for a locking pin, which connects through feed passages with a valved oil pressure supply. A solenoid-actuated hydraulic control valve may be used to selectively communicate oil pressure from a main source of pressurized oil to the locking pin for cylinder deactivation. Alternately, the solenoid-actuated hydraulic control valve operates to exhaust oil pressure from the locking pin and feed passage. Traditionally, one solenoid-actuated hydraulic control valve is provided for each cylinder that is to be deactivated. Such a system is described in commonly assigned U.S. Pat. No. 6,584,951, entitled "Individual Hydraulic Circuit Modules for Engine With Hydraulically-Controlled Cylinder Deactivation", which is hereby incorporated by reference in its entirety.

SUMMARY OF THE INVENTION

Accordingly, an internal combustion engine is provided with a cylinder block defining a plurality of cylinders at least half of which are selectively deactivatable by a plurality of switching hydraulic lifters. A source of pressurized oil is also provided. At least one solenoid-actuated hydraulic control valve, such as an on/off type valve, operates to selectively communicate pressurized oil from the source of pressurized oil to actuate the plurality of switching hydraulic lifters thereby deactivating the at least half of the plurality of cylinders. The number of the at least one solenoid-actuated hydraulic control valves is fewer than the number of the at least half of the plurality of cylinders that are selectively deactivatable.

The source of pressurized oil may be a main passage defined within the cylinder block. A pump may be provided to draw oil from a reservoir and provide pressurized oil to the main passage. At least one rotatable camshaft may be provided, wherein the at least one rotatable camshaft engages the plurality of switchable hydraulic lifters to effect reciprocal movement thereof.

Additionally, an oil manifold assembly may be removably mounted with respect to the internal combustion engine. The oil manifold assembly defines at least one feed passage and a control passage operable to receive pressurized oil from the main source of pressurized oil. Each of the at least one solenoid-actuated hydraulic control valve may be mounted with respect to the oil manifold assembly and selectively communicate pressurized oil from the control passage to a respective one of the at least one feed passage. The at least one feed passage operates to selectively communicate pressurized oil to the plurality of switching hydraulic lifters.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
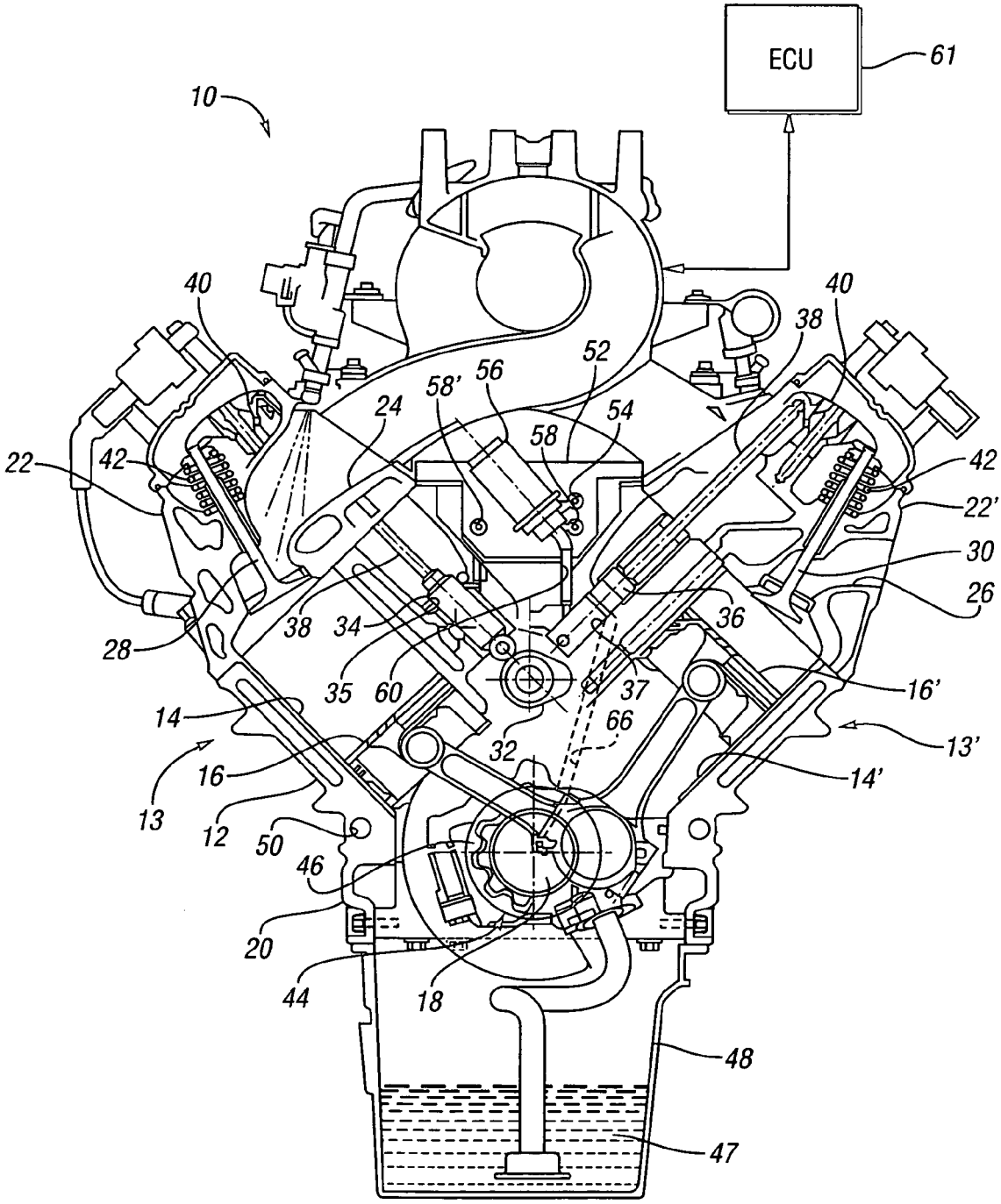
FIG. 1 is a is a rear cross sectional view of an eight cylinder internal combustion engine having a V-type configuration and employing a cylinder deactivation system consistent with the present invention.

Referring to the drawings wherein like reference numbers correspond to similar components, there is shown in FIG. 1 an internal combustion engine, generally indicated at 10. The engine 10 is an eight cylinder overhead valve engine, however, those skilled in the art will recognize that the engine 10 may have an alternate number of cylinders such as four, six, ten, twelve, or even sixteen arranged in differing configurations while remaining within the scope of that which is claimed. The engine 10 includes a cylinder block 12 having a first and second bank 13 and 13' of cylinders 14 and 14', respectively, arranged in a V-shaped configuration. Each of the cylinders 14 and 14' contain a respective piston 16 and 16' reciprocally movable therein by the rotation of a crankshaft 18. The crankshaft 18 is rotatably supported by main bearings, not shown, within a crankcase portion 20 of the cylinder block 12. The cylinders 14 and 14' are capped or closed at one end by a respective cylinder head 22 and 22' that define intake ports, such as 24 and exhaust ports, such as 26, each of which is selectively opened to a respective cylinder 14 and 14' by intake and exhaust valves 28 and 30, respectively.

The valves 28 and 30 are actuated by valve actuation mechanisms including a camshaft 32 rotatably driven by the crankshaft 18. The camshaft 32 engages valve lifters including, both hydraulic lifters, such as 34 and so called switching hydraulic lifters, such as 36. The hydraulic lifters 34 are reciprocally movable respectively within bores, such as 35, while the switching hydraulic lifters 36 are reciprocally movable respectively within bores, such as 37. The lifters 34 and 36 engage push rods 38, which connect with rocker arms 40 to actuate the valves 28 and 30 against the bias force of valve springs 42.

The engine 10 includes a lubrication and cylinder deactivation control circuit 44, which includes an oil pump 46 that is driven by the crankshaft 18. The oil pump 46 is a positive displacement-type pump that draws oil 47 from a reservoir or oil pan 48 mounted below the crankcase portion 20 of the cylinder block 12. The oil pump 46 supplies pressurized oil to a main passage 50, defined by the cylinder block 12, which operates as a source of pressurized oil.

The engine 10 also includes an oil manifold assembly 52 removably mounted thereto and defining a control passage 54 that receives pressurized oil from the main passage 50. The oil manifold assembly 52 includes solenoid-actuated hydraulic control valves 56 and 56' (shown in FIG. 2) each of which is operable to selectively provide pressurized oil from the control passage 54 to a respective feed passage 58 and 58'. The solenoid-actuated hydraulic control valves 56 and 56' are preferably on/off type valves. Each of the feed passages 58 and 58' are defined by the oil manifold assembly 52 and operate to selectively communicate pressurized oil to the bores 37 of the switching hydraulic lifters 36 via passages, such as 60. The passages 60 are at least partially defined by the oil manifold assembly 52 and the cylinder block 12. An electronic control unit, or ECU 61, is provided in electrical communication with the engine 10. The ECU 61 preferably includes a pre-programmable digital computer, and operates to selectively provide electrical potential to control the operation of the solenoid-actuated hydraulic control valves 56 and 56'.

Figure 2:
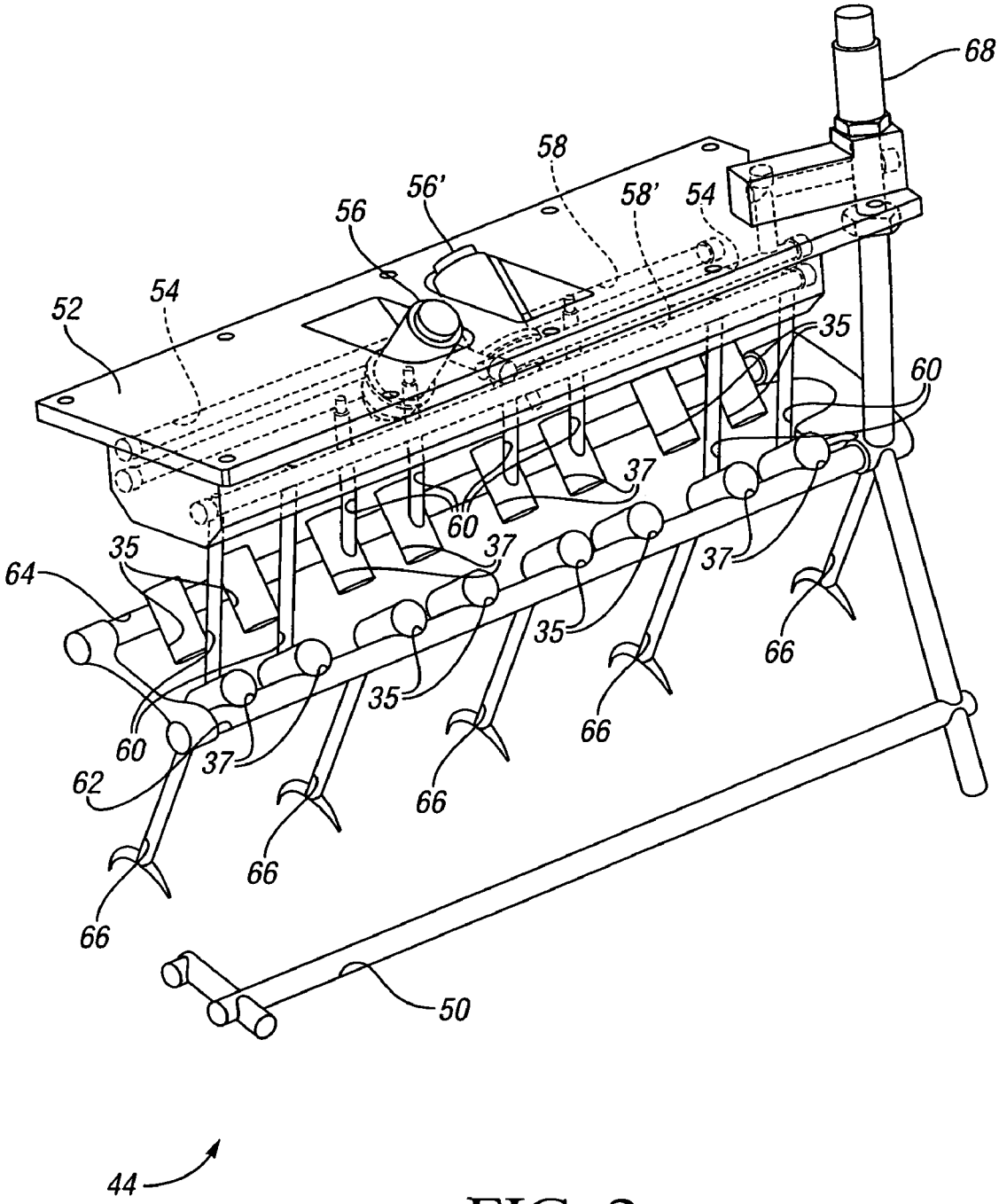
FIG. 2 is a schematic perspective view of a lubrication and cylinder deactivation control circuit, for the internal combustion engine shown in FIG. 1, illustrating various aspects consistent with the present invention.

Referring now to FIG. 2, there is shown a schematic representation of a portion of the lubrication and cylinder deactivation control circuit 44. The main passage 50 communicates pressurized oil directly to lifter oil passages 62 and 64, which supply pressurized oil to the lifters 34 and 36, shown in FIG. 1, for actuating hydraulic lash adjusters, not shown, contained therein. The lifter oil passage 62 also communicates pressurized oil through a plurality of passages 66 directly to the main bearings, not shown, for lubrication. A pressure sensor 68 may be provided in communication with the main passage 50 to provide diagnostic signals to ECU 61, shown in FIG. 1.

Figure 3:
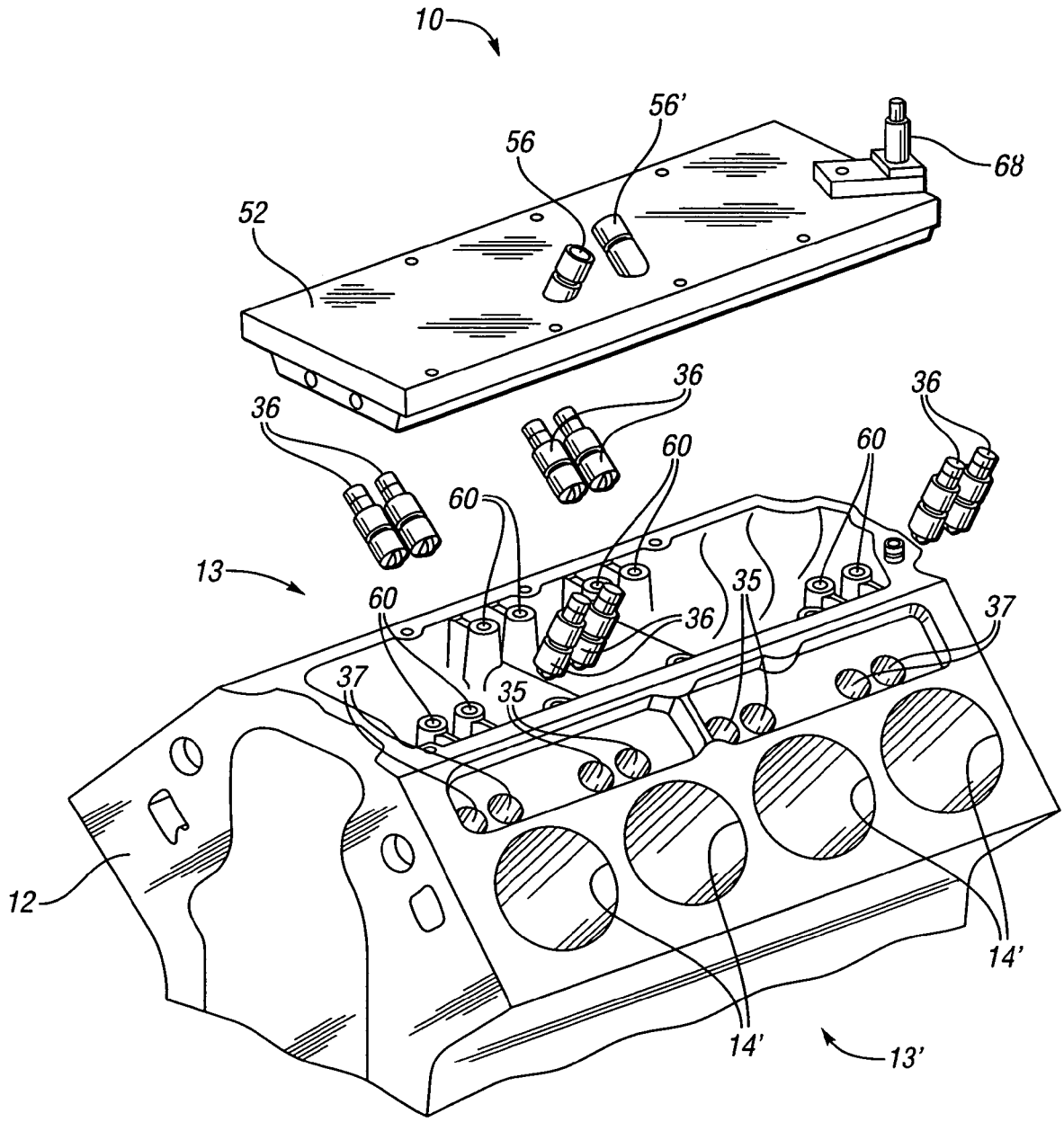
FIG. 3 is a schematic exploded view of a portion of the internal combustion engine shown in FIG. 1 illustrating various components of the cylinder deactivation system.

The operation of the engine 10 can best be understood with reference to FIGS. 1 through 3. The rapidly expanding combustion gases within the respective cylinders 14 and 14' drive the reciprocal motion of the pistons 16 and 16'. This reciprocal motion rotates the crankshaft 18 to output a torque from the engine 10. The rotation of the crankshaft 18 drives the oil pump 46 to supply pressurized oil to the lubrication and cylinder deactivation control circuit 44 through the main passage 50. The pressurized oil is utilized to lubricate moving parts within the engine 10 such as, for example, the pistons 16 and 16', camshaft 32, lifters 34 and 36, rocker arms 40, and other movable components known to those skilled in the art. The pressurized oil is also utilized to actuate the lash adjusters provided within the lifters 34 and 36.

Additionally, the main passage 50 supplies pressurized oil to the control passage 54 within the oil manifold assembly 52. The pressurized oil from within the control passage 54 is selectively communicated to the feed passages 58 and 58' by a respective one of the solenoid-actuated hydraulic control valves 56 and 56'. The pressurized oil, when present within the feed passages 58 and 58', is communicated via the plurality of passages 60 to a respective one of the bores 37. When full displacement, i.e. all cylinders 14 and 14' producing power, is desired, the solenoid-actuated hydraulic control valves 56 and 56' exhaust or de-pressurize the respective feed passages 58 and 58' and the plurality of passages 60. With the plurality of passages 60 de-pressurized, the switching hydraulic lifters 36 remain locked in the operating position. When deactivation of the cylinders 14 and 14' associated with the switching hydraulic lifters 36 is desired, the ECU 61 commands the solenoid-actuated hydraulic control valves 56 and 56' to open thereby pressurizing the feed passages 58 and 58', respectively, and hence the plurality of passages 60. The pressurized oil unlatches locking pins disposed within the switching hydraulic lifters 36, which allow the lifter bodies to telescope around their lash adjusters and thus disable operation of the valves 28 and 30 in mechanical communication with the switching lifters 36.

By deactivating half of the eight cylinders 14 and 14' of the engine 10 during low torque demand modes of engine operation, the operating efficiency of the engine 10 may be improved. Additionally, it is preferred that every other cylinder 14 and 14' within the firing sequence of the engine 10 be deactivated such that engine balance is maintained.

Figure 4:
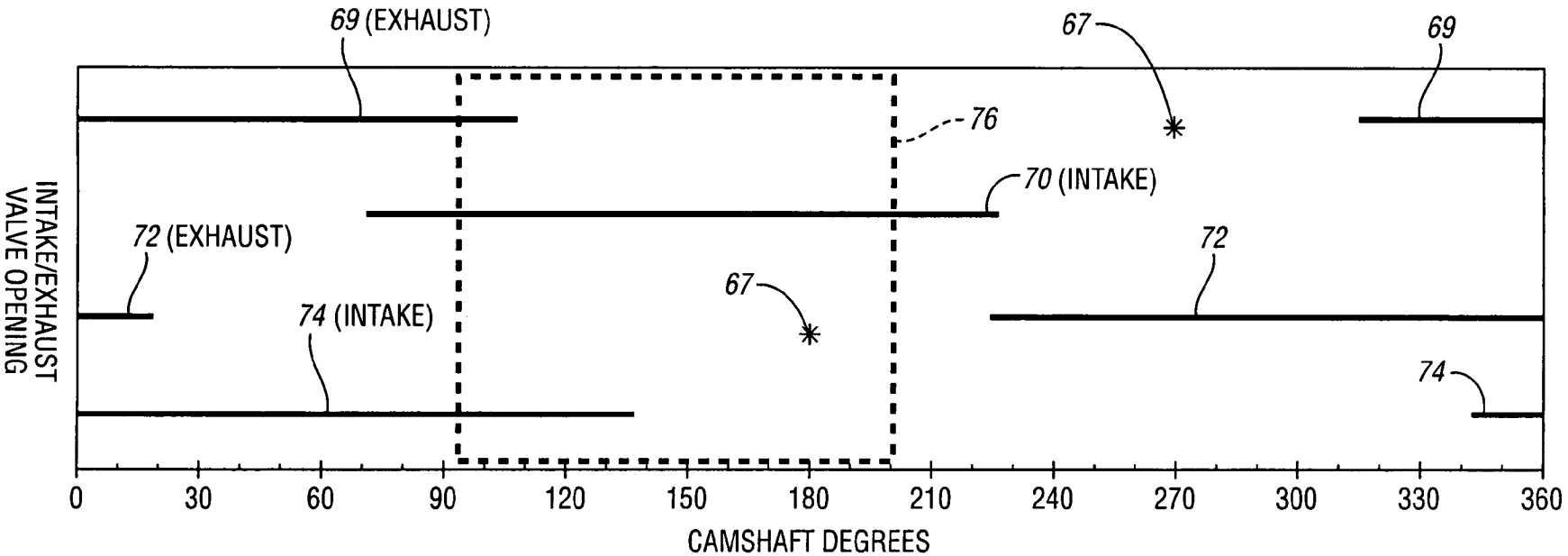
FIG. 4 is a graphical illustration of valve opening timing as a function of camshaft degrees illustrating a deactivation/reactivation timing window to control the deactivation of two cylinders using only one solenoid-actuated hydraulic control valve.

With reference to FIG. 4, and continued reference to FIG. 1 through 3, there is shown a graphical illustration of the opening timing of the intake valve 28 and exhaust valve 30 of a pair of cylinders 14 or 14' that are selectively deactivatable by one of the solenoid-actuated hydraulic control valves 56 and 56'. The opening timing of the intake valve 28 and exhaust valves 30 are given as a function of camshaft degrees, i.e. rotation of the camshaft 32. The start of the power stroke for the respective cylinders 14 or 14' is also represented. This point, indicated at 67, indicates the phase in the engine cycle where the piston 16 or 16' reaches top dead center or TDC of the compression stroke and reverses movement toward bottom dead center or BDC to begin the power stroke. At point 67, a fraction of the fuel and air charge within the cylinders 14 or 14' has been burnt and the engine 10 will sustain combustion through a portion of the power stroke. A line 69 represents the opening timing of the exhaust valve 30 associated with the first deactivatable cylinder 14 or 14', while line 70 represents the opening timing of the intake valve 28 associated with the first deactivatable cylinder 14 or 14'. A line 72 represents the opening timing of the exhaust valve 30 associated with the second deactivatable cylinder 14 or 14', while line 74 represents the opening timing of the intake valve 28 associated with the second deactivatable cylinder 14 or 14'. The selectively deactivatable cylinders 14 or 14', which are manifolded or joined to a respective one of the solenoid-actuated hydraulic control valves 56 and 56', are preferably selected such that a deactivation/reactivation timing window, shown as 76 in FIG. 4, provides for the deactivation of the respective exhaust valves 30 prior to the respective intake valves 28. Additionally, upon reactivation of the cylinders 14 or 14', the deactivation/reactivation timing window 76 is chosen such that the respective exhaust valves 30 reactivate prior to the respective intake valves 28. The deactivation/reactivation timing window 76 indicates the range of camshaft rotation, and therefore rotation of the crankshaft 18, that the respective solenoid-actuated hydraulic control valve 56 or 56' is preferably opened. The intake valve 28 and the exhaust valve 30 will only deactivate when in or near the closed position. Therefore, even though the intake valve 28 and the exhaust valve 30 are commanded to deactivate at the same time, the phasing of the deactivation is dependent upon the position of the intake valve 28 and exhaust valve 30 as well as the selective energization of the solenoid-actuated hydraulic control valves 56 and 56'.

By employing such a strategy, the fuel and air charge can be introduced into the selectively deactivatable cylinder 14 or 14', which is then combusted. Since the exhaust valves 30 are deactivated, the products of combustion will remain within the deactivated cylinder 14 or 14' until reactivated. This strategy is preferable since the products of combustion exiting the deactivated cylinder 14 or 14', upon reactivation, will contain very little oxygen. Therefore, the need for complex control algorithms within the ECU 61 to momentarily deactivate oxygen sensors, not shown, within the vehicle exhaust system in order to maintain proper fuel injection control is obviated.

The engine 10 can, by manifolding the solenoid-actuated hydraulic control valves 56 and 56' with the bores 37, deactivate the four selectively deactivatable cylinders using only two solenoid-actuated hydraulic control valves 56 and 56'. By reducing the number of solenoid control valves required to effect cylinder deactivation, the cost and complexity of the engine 10 may be reduced while maintaining proper control of the cylinder deactivation functionality.

While the best modes for carrying out the invention have been described in detail, those familiar with the art to which this invention relates will recognize various alternative designs and embodiments for practicing the invention within the scope of the appended claims.

The invention claimed is:

1. An internal combustion engine comprising:

a cylinder block defining a plurality of cylinders at least half of said plurality of cylinders being selectively deactivatable by a plurality of switching hydraulic lifters;

a source of pressurized oil;

at least one solenoid-actuated hydraulic control valve operable to selectively communicate pressurized oil from said source of pressurized oil to actuate said plurality of switching hydraulic lifters thereby deactivating said at least half of said plurality of cylinders;

an electronic control unit in electrical communication with said at least one solenoid-actuated hydraulic control valve;

a plurality of selectively deactivatable intake valves each of which is in mechanical communication with a respective one of said plurality of switching hydraulic lifters; and a plurality of selectively deactivatable exhaust valves each of which is in mechanical communication with a respective one of said plurality of switching hydraulic lifters;

wherein the number of said at least one solenoid-actuated hydraulic control valves is fewer than the number of said at least half of said plurality of cylinders that are selectively deactivatable; and wherein said electronic control unit is operable to command said at least one solenoid-actuated hydraulic control valve to selectively deactivate said plurality of selectively deactivatable exhaust valves and intake valves only when in or near respective closed positions.

2. The internal combustion engine of claim 1, wherein each of said at least one solenoid operated control valve is an on/off type valve.

3. The internal combustion engine of claim 1, wherein said source of pressurized oil is a main passage defined within said cylinder block.

4. The internal combustion engine of claim 3, further comprising:

a pump operable to draw oil from a reservoir; and wherein said pump is operable to provide pressurized oil to said main passage.

5. The internal combustion engine of claim 1, further comprising:

at least one rotatable camshaft; and wherein said at least one rotatable camshaft engages said plurality of switchable hydraulic lifters to effect reciprocal movement thereof.

6. The internal combustion engine of claim 1, further comprising:

an oil manifold assembly removably mounted with respect to the internal combustion engine, said oil manifold assembly defining at least one feed passage and a control passage operable to receive pressurized oil from said main source of pressurized oil;

wherein each of said at least one solenoid-actuated hydraulic control valve is mounted with respect to said oil manifold assembly and is operable to selectively communicate pressurized oil from said control passage to a respective one of said at least one feed passage; and wherein said at least one feed passage is operable to selectively communicate pressurized oil to said plurality of switching hydraulic lifters.

7. The internal combustion engine of claim 1, wherein said electronic control unit is operable to command said at least one solenoid-actuated hydraulic control valve to selectively deactivate said plurality of selectively deactivatable exhaust valves prior to said plurality of selectively deactivatable intake valves; and wherein said electronic control unit is operable to command said at least one solenoid-actuated hydraulic control valve to selectively reactivate said plurality of selectively deactivatable exhaust valves prior to said plurality of selectively deactivatable intake valves.

8. The internal combustion engine of claim 6, wherein said at least one feed passage includes a first feed passage in fluid communication with a first of said at least one solenoid-actuated hydraulic control valves, and a second feed passage in fluid communication with a second of said at least one solenoid-actuated hydraulic control valves.

9. The internal combustion engine of claim 8, wherein said first feed passage fluidly communicates said first solenoid-actuated hydraulic control valve with respective ones of said plurality of switching hydraulic lifters disposed within a first cylinder bank of the cylinder block, and wherein said second feed passage fluidly communicates said second solenoid-actuated hydraulic control valve with respective ones of said plurality of switching hydraulic lifters disposed within a second cylinder bank of the cylinder block.

10. A cylinder deactivation system for an internal combustion engine having a cylinder block with a plurality of deactivatable cylinders each having at least one selectively deactivatable intake valve and at least one selectively deactivatable exhaust valve, the system comprising:

a main source of pressurized oil;

a plurality of switching hydraulic lifters operable to deactivate the deactivatable cylinders in response to a pressurized oil signal;

an oil manifold assembly defining a control passage and at least one feed passage, said control passage being in fluid communication with said main source of pressurized oil;

at least one solenoid-actuated hydraulic control valve;

wherein a first of said at least one solenoid-actuated hydraulic control valves is operable to selectively communicate pressurized oil from said control passage to a first of said at least one feed passage;

wherein a second of said at solenoid-actuated hydraulic control valves is operable to selectively communicate pressurized oil from said control passage to a second of said at least one feed passage;

wherein said first feed passage selectively communicates pressurized oil to respective ones of said plurality of switching lifters disposed within a first cylinder bank of the cylinder block to effect cylinder deactivation;

wherein said second feed passage selectively communicates pressurized oil to respective ones of said plurality of switching lifters disposed within a second cylinder bank of the cylinder block to effect cylinder deactivation; and wherein the number of at least one solenoid-actuated hydraulic control valves is fewer than the plurality of deactivatable cylinders.

11. The cylinder deactivation system of claim 10, wherein each of said at least one solenoid-actuated hydraulic control valve is an on/off type valve.

12. The cylinder deactivation system of claim 10, further comprising:

an electronic control unit in electrical communication with said at least one solenoid-actuated hydraulic control valve;

wherein said electronic control unit is operable to command said at least one solenoid-actuated hydraulic control valve to selectively deactivate the at least one selectively deactivatable exhaust valve, associated with the plurality of deactivatable cylinders, prior to the at least one selectively deactivatable intake valve, associated with the plurality of deactivatable cylinders; and wherein said electronic control unit is operable to command said at least one solenoid-actuated hydraulic control valve to reactivate the at least one selectively deactivatable exhaust valve, associated with the plurality of deactivatable cylinders, prior to the at least one selectively deactivatable intake valve, associated with the plurality of deactivatable cylinders.

13. The cylinder deactivation system of claim 10, further comprising:

an electronic control unit in electrical communication with said at least one solenoid-actuated hydraulic control valve;

wherein said electronic control unit is operable to command said at least one solenoid-actuated hydraulic control valve to selectively deactivate the at least one selectively deactivatable exhaust valve and intake valve only when in or near substantially closed positions.

14. An internal combustion engine comprising:

a cylinder block defining a plurality of cylinders at least two of said plurality of cylinders being selectively deactivatable by a plurality of switching hydraulic lifters;

a source of pressurized oil;

at least one solenoid-actuated hydraulic control valve;

an electronic control unit in electrical communication with said at least one solenoid-actuated hydraulic control valve;

a plurality of selectively deactivatable intake valves each of which is in mechanical communication with a respective one of said plurality of switching hydraulic lifters; and a plurality of selectively deactivatable exhaust valves each of which is in mechanical communication with a respective one of said plurality of switching hydraulic lifters;

wherein each of said at least one solenoid-actuated hydraulic control valve is operable to selectively communicate pressurized oil from said source of pressurized oil to actuate said plurality of switching hydraulic lifters thereby deactivating said at least two of said plurality of cylinders;

wherein the number of said at least one solenoid-actuated hydraulic control valves is fewer than the number of said at least two of said plurality of cylinders that are selectively deactivatable;

wherein said electronic control unit is operable to command said at least one solenoid-actuated hydraulic control valve to selectively deactivate said plurality of selectively deactivatable exhaust valves prior to said plurality of selectively deactivatable intake valves; and wherein said electronic control unit is operable to command said at least one solenoid-actuated hydraulic control valve to selectively reactivate said plurality of selectively deactivatable exhaust valves prior to said plurality of selectively deactivatable intake valves.

15. The internal combustion engine of claim 14, wherein each of said at least one solenoid-actuated hydraulic control valve is an on/off type valve.

16. The internal combustion engine of claim 14, wherein said source of pressurized oil is a main passage defined within said cylinder block.

17. The internal combustion engine of claim 16, further comprising:

a pump operable to draw oil from a reservoir; and wherein said pump is operable to provide pressurized oil to said main passage.

18. The internal combustion engine of claim 14, further comprising:

at least one rotatable camshaft; and wherein said at least one rotatable camshaft engages said plurality of switchable hydraulic lifters to effect reciprocal movement thereof

19. The internal combustion engine of claim 14, further comprising:

wherein said electronic control unit is operable to command said at least one solenoid-actuated hydraulic control valve to selectively deactivate said plurality of selectively deactivatable exhaust valves and intake valves only when in or near substantially closed positions.;

* * * * *